US012221848B2

(12) United States Patent
Cheng et al.

(10) Patent No.: US 12,221,848 B2
(45) **Date of Patent: *Feb. 11, 2025**

(54) CASING SLIP HANGER RETRIEVAL TOOL SYSTEM AND METHOD

(71) Applicant: Baker Hughes Oilfield Operations LLC, Houston, TX (US)

(72) Inventors: Samuel Cheng, Katy, TX (US); Eugene Borak, Houston, TX (US); Gajanan Hegde, Houston, TX (US); James Richeson, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/591,940

(22) Filed: Feb. 29, 2024

(65) Prior Publication Data

US 2024/0200420 A1 Jun. 20, 2024

Related U.S. Application Data

(63) Continuation of application No. 17/552,962, filed on Dec. 16, 2021, now Pat. No. 11,939,832.

(60) Provisional application No. 63/127,273, filed on Dec. 18, 2020.

(51) Int. Cl.
*E21B 33/035* (2006.01)
*E21B 33/04* (2006.01)

(52) U.S. Cl.
CPC ..... *E21B 33/0422* (2013.01); *E21B 33/0355* (2013.01)

(58) Field of Classification Search
CPC ..... E21B 33/0355; E21B 33/0422
See application file for complete search history.

(56) References Cited

U.S. PATENT DOCUMENTS 3,179,448 A * 4/1965 Jones ..... E21B 33/0422 285/123.6
3,350,130 A * 10/1967 Ahlstone ..... E21B 17/1007 294/93
3,468,559 A 9/1969 Ahlstone
(Continued)

FOREIGN PATENT DOCUMENTS

EP 0378040 A1 7/1990
EP 0523301 A1 * 1/1993
(Continued)

OTHER PUBLICATIONS

Notice of Allowance mailed Nov. 1, 2023 in related U.S. Appl. No. 17/552,949.

(Continued)

*Primary Examiner* — Matthew R Buck
(74) *Attorney, Agent, or Firm* — Baker Hughes Patent Organization

(57) ABSTRACT

A wellbore system includes a slip hanger arranged within a wellbore component, the slip hanger having a mechanical receptacle formed in a face of the slip hanger. The wellbore system also includes an adapter configured to couple to the slip hanger, the adapter having one or more engagement members arranged to engage the mechanical receptacle, wherein the one or more engagement members extend into the mechanical receptacle to secure the slip hanger to the adapter.

20 Claims, 10 Drawing Sheets

(56) References Cited

U.S. PATENT DOCUMENTS

| | | | | |
|---|---|---|---|---|
| 3,693,714 | A | 9/1972 | Baugh | |
| 4,003,434 | A * | 1/1977 | Garrett | E21B 33/043 166/212 |
| 4,736,799 | A | 4/1988 | Ahlstone | |
| 4,880,061 | A | 11/1989 | Ahlstone | |
| 4,979,566 | A * | 12/1990 | Hosie | E21B 33/043 166/312 |
| 6,095,242 | A * | 8/2000 | Lequang | E21B 33/0422 166/368 |
| 8,955,604 | B2 | 2/2015 | Gette | |
| 9,133,679 | B2 * | 9/2015 | Robottom | E21B 34/14 |
| 10,145,185 | B2 * | 12/2018 | Nguyen | E21B 33/03 |
| 10,196,872 | B2 * | 2/2019 | Kauffmann | E21B 33/1212 |
| 10,287,838 | B2 * | 5/2019 | Van Bilderbeek | E21B 33/04 |
| 10,480,273 | B2 * | 11/2019 | Chirko | E21B 33/04 |
| 11,939,832 | B2 * | 3/2024 | Cheng | E21B 33/0355 |
| 2003/0042027 | A1 * | 3/2003 | Lang | E21B 33/0422 166/382 |
| 2004/0129429 | A1 | 7/2004 | Dallas | |
| 2004/0251031 | A1 | 12/2004 | Reimert | |
| 2011/0240306 | A1 | 10/2011 | Neto | |
| 2012/0305269 | A1 * | 12/2012 | Bories | E21B 33/043 166/208 |
| 2013/0098635 | A1 | 4/2013 | Gette | |
| 2017/0191324 | A1 | 7/2017 | Nguyen | |
| 2019/0024472 | A1 * | 1/2019 | Lugo | E21B 33/0422 |
| 2022/0195826 | A1 | 6/2022 | Cheng et al. | |
| 2023/0132558 | A1 | 5/2023 | Cheng et al. | |

FOREIGN PATENT DOCUMENTS

| | | | | |
|---|---|---|---|---|
| EP | 3342975 | A1 | 7/2018 | |
| WO | WO-2013158030 | A1 * | 10/2013 | E21B 33/0422 |
| WO | 2018118653 | A1 | 6/2018 | |

OTHER PUBLICATIONS

Notice of Allowance mailed Aug. 2, 2023 in related U.S. Appl. No. 17/552,949.

Non-Final Office Action mailed Apr. 26, 2023 in related U.S. Appl. No. 17/552,949.

Notice of Allowance mailed Nov. 22, 2023 in related U.S. Appl. No. 17/552,962.

Final Office Action mailed Sep. 7, 2023 in related U.S. Appl. No. 17/552,962.

Non-Final Office Action mailed Apr. 3, 2023 in related U.S. Appl. No. 17/552,962.

Final Office Action mailed Dec. 22, 2022 in related U.S. Appl. No. 17/552,962.

Non-Final Office Action mailed Jul. 13, 2022 in related U.S. Appl. No. 17/552,962.

International Search Report and Written Opinion mailed Apr. 11, 2022 in corresponding PCT Application No. PCT/US2021/073006.

International Search Report and Written Opinion mailed Apr. 11, 2022 in corresponding PCT Application No. PCT/US2021/073008.

* cited by examiner

CASING SLIP HANGER RETRIEVAL TOOL SYSTEM AND METHOD

CROSS-REFERENCE TO RELATED APPLICATIONS

This application is a continuation of U.S. patent application Ser. No. 17/552,962, filed Dec. 16, 2021, entitled "CASING SLIP HANGER RETRIEVAL TOOL SYSTEM AND METHOD," which claims priority to U.S. Provisional Application Ser. No. 63/127,273, filed Dec. 18, 2020, entitled "EMERGENCY CASING SLIP HANGER RETRIEVAL TOOL SYSTEM AND METHOD," the full disclosures of which are hereby incorporated herein in their entireties for all purposes.

BACKGROUND

1. Field of Disclosure

This disclosure relates in general to oil and gas tools, and in particular, to systems and methods for retrieval devices.

2. Description of the Prior Art

In exploration and production of formation minerals, such as oil and gas, wellbores may be drilled into an underground formation. The wellbores may include various drilling, completion, or exploration components, such as hangers or sealing systems that may be arranged in a downhole portion or at a surface location. Often, these components may be hand installed at a surface location by operators and then lowered into the wellbore. Removal of these devices while within the wellbore may be challenging.

SUMMARY

Applicant recognized the problems noted above herein and conceived and developed embodiments of systems and methods, according to the present disclosure, for wellbore operations.

In an embodiment, a wellbore system, includes a slip hanger arranged within a wellbore component, the slip hanger having a mechanical receptacle formed in a face of the slip hanger. The wellbore system also includes an adapter configured to couple to the slip hanger, the adapter having one or more engagement members arranged to engage the mechanical receptacle, wherein the one or more engagement members extend into the mechanical receptacle to secure the slip hanger to the adapter to aid in retrieval of the slip hanger.

In an embodiment, a wellbore system includes a running tool and an adapter adapted to connect to the running tool, the adapter having a bore to receive at least a portion of the running tool and a slot to receive one or more coupling devices associated with the running tool. The wellbore system also includes a slip hanger arranged within a wellbore, the slip hanger supporting at least a portion of a tubular, the slip hanger having slips and a slip bowl, wherein the slip bowl includes one or more grooves configured to couple to one or more engagement members of the adapter. The running tool is configured to couple to the adapter, move the adapter toward the slip hanger, facilitate coupling of the adapter to the slip hanger, and to disengage from the adapter.

In an embodiment, a method for removing a downhole component includes coupling an adapter to a slip hanger arranged within a wellbore component. The method also includes releasing the adapter from a running tool. The method further includes cutting a portion of a casing string suspended from the slip hanger. The method also includes engaging a lower surface of the slip hanger with one or more of a collar or coupling of the casing string, the one or more of the collar or the coupling being moved in an upward direction after the cutting to remove the casing string from the wellbore.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
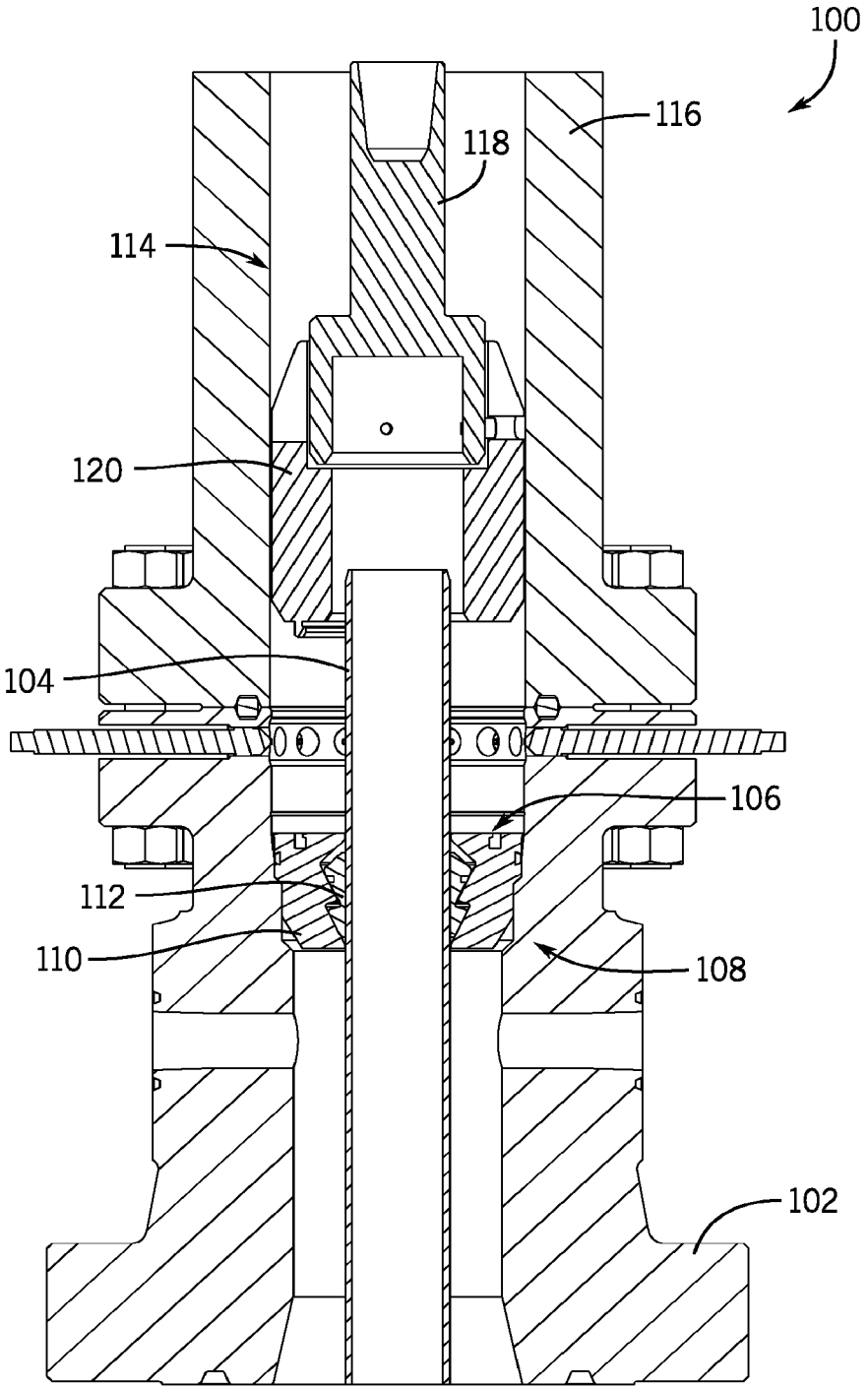
FIG. 1 is a cross-sectional view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward systems and methods for retrieval tools, which may include systems and methods for removal of an emergency casing/tubing slip hanger. In various embodiments, removal may be performed through a workover/drilling package such as a blowout preventer. In at least one embodiment, systems and methods enable removal of the downhole component through the workover package immediately or without significant delay after the removal of the annulus packoff, without removing the equipment above. Accordingly, systems and methods reduce rig time as no equipment will be changed out between the workover package and the wellhead during operations.

In various embodiments, systems and methods of the present disclosure may be directed toward retrieval of a slip hanger. The system may lock both slip hanger halves together and serve as a centralizer and guide to enable removal of the slip hanger through the workover package following a casing cutting and spearing operation. In embodiments, a retrieval tool may be run on drill pipe through the workover package. The retrieval tool may then engage the slip hanger for the recovery of the slip hanger. The cut casing may then be pulled through the slip hanger until a casing coupling, which has an outer diameter extending out past the casing diameter, tagged on the lower face of the slip bowl. The lower face of the slip bowl is defined with an internal diameter that is larger than the casing outer diameter, but smaller than the casing coupling outer diameter. The entire assembly may then be retrieved through the workover package. In various embodiments, the retrieval tool may help guide the slip hanger through equipment above without snagging in obstructions or discontinuities, such as a blowout preventer ram cavity.

Various embodiments of the present disclosure enable the slip hanger to be held together for the retrieval operation, which would typically be done by hand. That is, components may be tripped to the surface for removal by operators. In at least one embodiment, the slip hanger may be engaged and pulled at the same time as the casing, using a casing coupling as the mechanism for lifting the slip bowl out of the wellhead. The slip hanger retrieval adapter rigidly holds the slip halves together and serves as a guide. This enhances the connection between the slip bowl halves, to ensure that the slip bowl does not separate during retrieval operations.

FIG. 1 is a cross-sectional view of an embodiment of a wellbore system 100 including a tubing spool 102 with a casing section 104 extending through a bore 106 of the tubing spool 102. Various embodiments may refer to an emergency completion or an emergency slip hanger, but it should be appreciated that systems and methods of the present disclosure may be used with a variety of different wellbore configurations in different stages. In this example, a slip hanger 108 is arranged within the tubing spool 102 to support the casing section 104. The illustrated slip hanger 108 may also be referred to as a hanger assembly that includes a slip bowl 110 that circumferentially surrounds segmented slips 112 arranged within the slip bowl 110. In various embodiments, the slip bowl 110 is a segmented component. That is, the slip bowl 110 may be split into two or more ring or circumferential sections. This configuration enables installation around the casing section 104 and may accommodate various changes in diameter or collars.

In at least one embodiment, a retrieval assembly 114 is shown extending through a wellbore tubular 116, which may be a portion of a workover package or a blow out preventer (BOP), among various options. It should be appreciated that the term wellbore tubular is used for convenience and in various embodiments systems and methods may be used for surface components such that the wellbore tubular 116 does not fully extend into a wellbore. The retrieval assembly 114 of this embodiment includes a running tool 118 and an adapter 120. As will be described below, the adapter 120 may include one or more gripping components that engage the slip hanger 108 (e.g., at least one component of the slip hanger 108, such as the slip bowl 110) to keep portions of the slip hanger 108 together and also to guide the slip hanger 108 out of the wellbore through uphole equipment, such as a BOP. It should be appreciated that existing techniques may scar or otherwise damage components when attempting to remove the slip hanger 108 because of twisting and/or misalignment during removal, and as a result, existing methods remove the upstream components prior to removal of the slip hanger. Embodiments of the present disclosure overcome these problems using the adapter 120 to both grip the slip hanger 108 and to guide the slip hanger 108 out of the wellbore.

As will be described various, various components that may be associated with an operational wellbore have been removed prior to utilization of the retrieval assembly 114. By way of example, one or more sealing systems may be positioned within the tubing spool 102, and may, in various embodiments, be secured in place using one or more seal fasteners, shown in FIG. 1 as extending into the bore 106 from an external location. Additionally, various embodiments may use sealing systems that do not include or utilize the seal fasteners. Furthermore, as noted above, it should be appreciated that the slip hanger 108 may be positioned along various different axial locations of the tubing spool 102.

Figure 2:
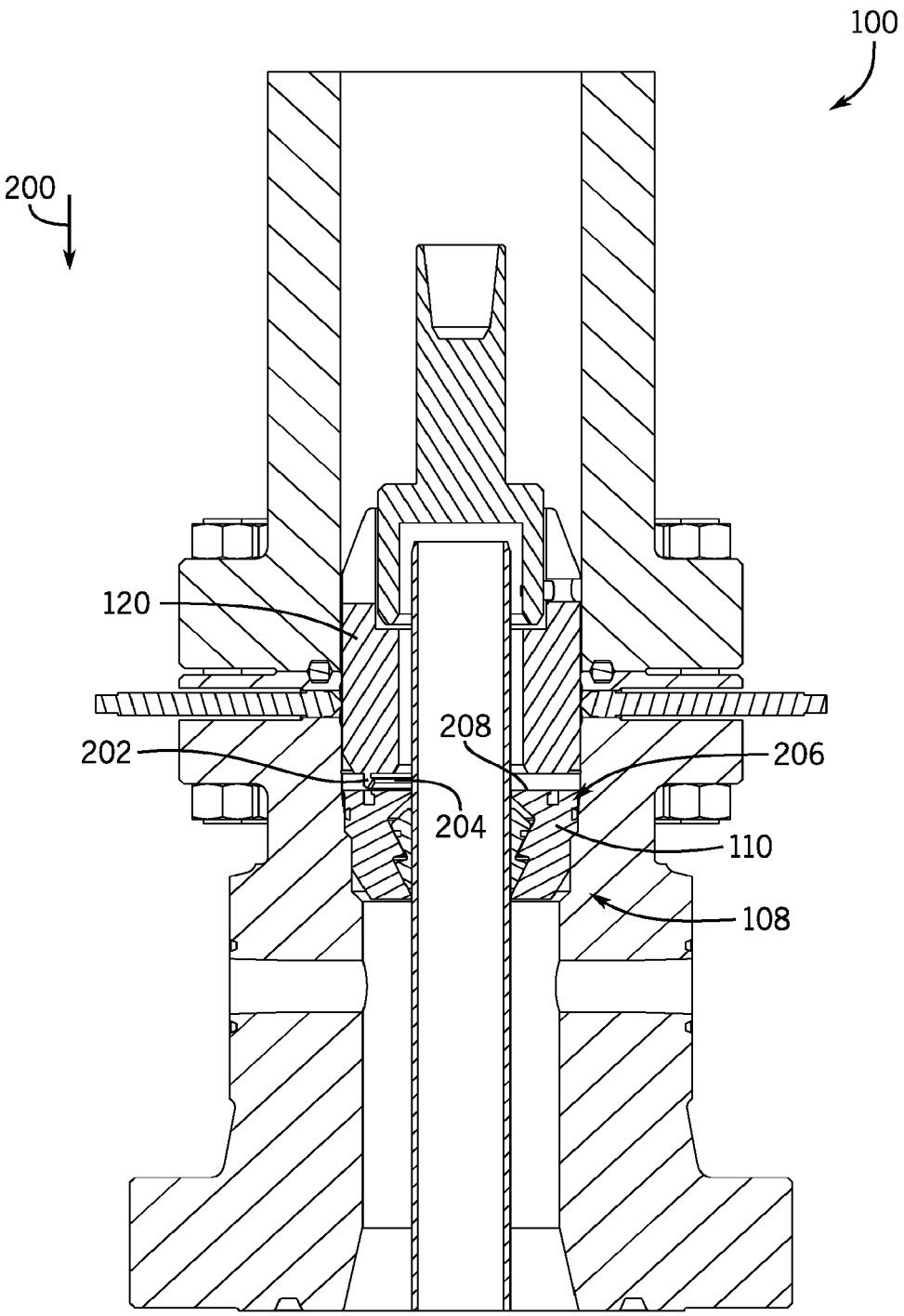
FIG. 2 is a cross-sectional view of an embodiment of a wellbore system, in accordance with embodiments of the present disclosure.

FIG. 2 is a cross-sectional view of the wellbore system 100 in which the adapter 120 has been moved in a downward direction 200 toward the slip hanger 108. That is, when compared to the view of FIG. 1, it can be seen that a distance between the adapter 120 and the slipper hanger 108 is reduced in FIG. 2. As shown, the slip hanger 108 includes fingers 202 (e.g., engagement members, gripping mechanisms) extending axially downward. In at least one embodiment, the fingers 202 extend axially lower than a body of the adapter 120. It should be appreciated that there may be any number of fingers 202 and that the illustrated configuration includes 2 (one being removed via the cross-section) as an example only. In various embodiments, the number of fingers 202 may correspond to a number of segments used to form the slip bowl 110 and/or various portions of the slip hanger 108. The fingers 202 may include one or more walls 204 or edges to facilitate coupling to the slip hanger 108. Additionally, the fingers 202 may include bends or other features to enable restrictions or force transfer capabilities after installation. In this example, the fingers 202 may be "j-fingers" that have a "j" shape (e.g., approximately 2 bends), but other configurations may also be used. Fingers are illustrated for example purposes only and other embodiments may be directed to various types of mechanical connection or interfacing features that are utilized to couple components together. By way of example only, the fingers may be related to coupling members that are driven into a mating receptacle and then an interference or extension may prevent separation between the components. Additionally, various embodiments may also be directed toward one or more features that cut into a mating component to form a coupling. In various embodiments, the fingers may also include one or more extendable parts such that the fingers may be lowered into a mating receptacle and then one or more extensions may move into an adjacent receptacle.

The fingers 202 are aligned with a groove 206 (e.g., mechanical receptacle) formed in the slip bowl 110. It should be appreciated that the groove is shown for illustrative purposes and that other embodiments may include various types of mechanical receptacles. For example, the groove may be replaced by individual apertures or fittings that receive a mating component associated with the adapter 120. The groove 206 may be particularly selected and sized to accommodate the fingers 202. That is, the groove 206 may have dimensions slightly larger than the fingers 202 to facilitate installation of the fingers 202 into the groove 206. It should be appreciated that the groove 206 may be shaped based at least in part on the fingers 202. As a result, the illustrated groove 206 may not be a continuous groove, but rather, a j-groove that, upon rotation of the adapter 120, may transmit a force to the slip bowl 110 at a mating edge. By way of example, the j-groove may not have a constant diameter along a length of depth of the j-groove such that the groove 206 corresponds to the finger 202. In this example, an upper region of the groove 206 has a smaller opening annulus area than a lower region of the groove 206. As such, the j-shape of the fingers 202 are accommodated. It should be appreciated that such a configuration is for example purposes and other examples may include different groove configurations. Furthermore, as noted above, the groove 206 may include one or more bends or other areas that facilitate receiving deployable parts. Additionally, in one or more embodiments, the groove 206 may be formed or otherwise enlarged by the fingers 202, such as in embodiments where the fingers 202 cut into the bowl 110.

In at least one embodiment, the groove 206 is arranged along an upstream surface 208 of the slip bowl 110. As noted above, it should be appreciated that grooves 206 may also, or alternatively, be formed in one or more additional components of the slip hanger 108. By way of example only, the slips 112 may also include one or more grooves 206 that may receive portions of the fingers 202.

Figure 3:
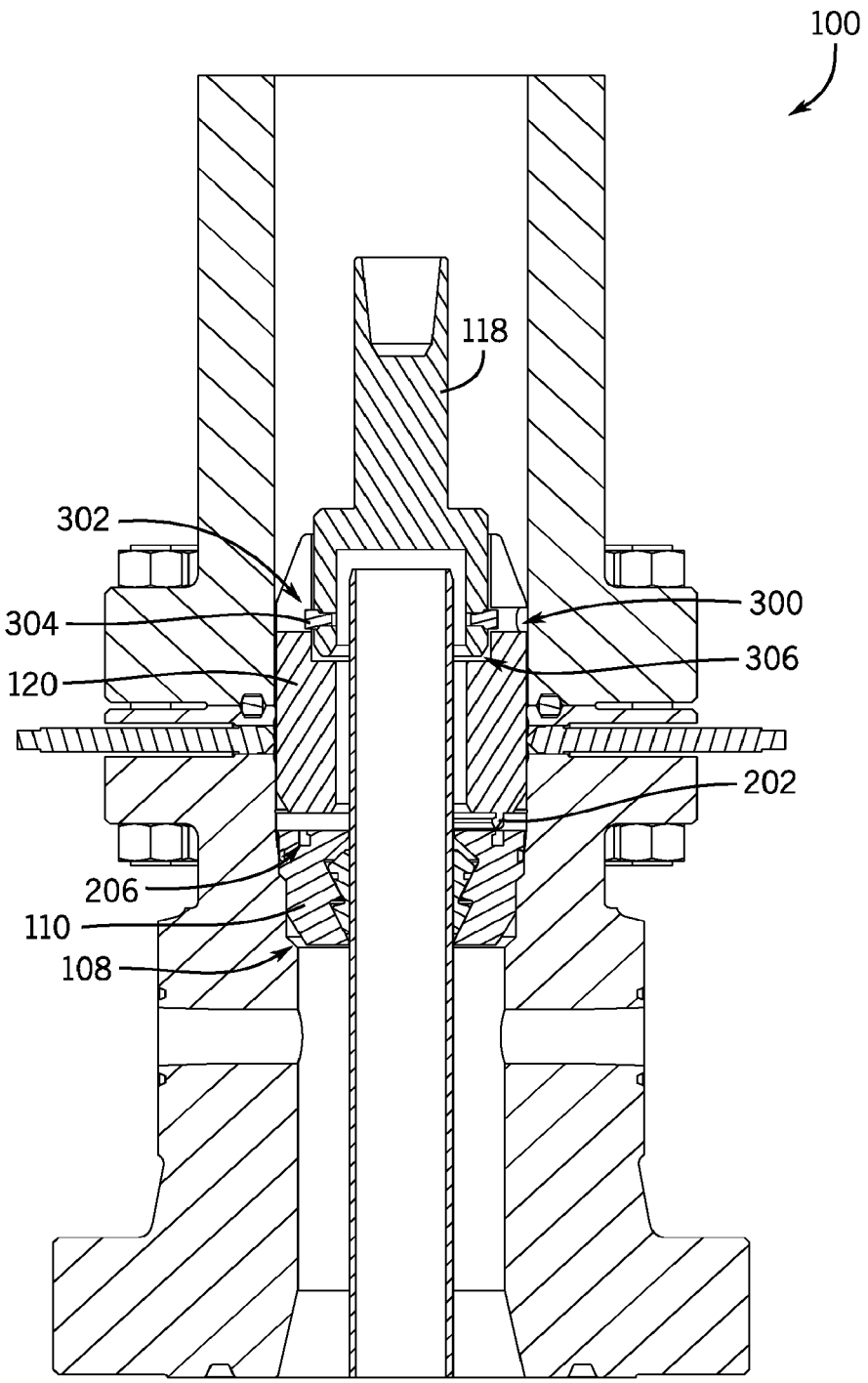
FIG. 3 is a cross-sectional view of an embodiment of a wellbore system, in accordance with embodiments of the present disclosure.

FIG. 3 is a cross-sectional view of an embodiment of the wellbore system 100 in which the fingers 202 are positioned proximate the groove 206. It should be appreciated that this is for example purposes and that other embodiments may include various other types of engagement between the components, such as individual mechanisms extending into mating apertures, teeth cutting into a surface, or the like. In this example, the adapter 120 has been rotated in the clockwise direction (compared to FIG. 2) such that the fingers 202 have translated within the bore 106. It should be appreciated that rotation is an example of a method for forming an engagement between the adapter 120 and the slip bowl 110. By way of example only, alternative configurations may include alignment between a gripping component and an aperture followed by a downward force (e.g., an applied force, force associated with the weight of the tool, etc.), such as in a snap fit or interference design, and the like. In various embodiments, rotation may be performed to align the fingers 202 with a predetermined position. For example, as illustrated, the fingers 202 are not fully extended into the groove, and in various embodiments, may only partially extend into the groove until positioned at a predetermined location. Further illustrated is a coupling between the running tool 118 and the adapter 120.

FIG. 3 illustrates the tool 118 and adapter 120 being rotated clockwise, when compared to FIG. 2. This arrangement aligns the fingers 202 with the groove 206 (e.g., with an entrance slot of the groove 206). Additionally, the illustrated arrangement disengages a slot 300, which may be a j-slot. For example, the clockwise rotation causes a coupling device 304 to move out of a horizontal part of the j-slot and into a vertical section of the j-slot. This allows for transmission of a rotational force while also permitting axial movement.

In this example, the adapter 120 includes the slots 300 to facilitate coupling to the running tool 118. For example, the running tool 118 is shown extending into the adapter 120 to align receptacles 302 with the slots 300 to enable the coupling devices 304 to secure the running tool 118 to the adapter 120. Further illustrated is a shelf 306 that receives and supports the running tool 118. The shelf 306 may be positioned such that the receptacles 210 align with the slots 300, thereby facilitating installation. It should be appreciated that the illustrated configuration is for example purposes only and that, in other embodiments, the adapter 120 may be arranged, at least partially, within a circumferential extent of the running tool 118.

In various embodiments, the coupling devices 304 are positioned within the slots 300 via one or more rotational and/or axial movements of the running tool 118 with respect to the adapter 120. For example, the slots 300 may form a portion of a j-slot or other configuration that permits axial movement of the running tool 118 to a certain point and then locks or otherwise blocks reverse movement after rotation of the running tool 118 with respect to the adapter 120. However, it should be appreciated that various embodiments of the present disclosure the slots 300, which may be associated with a j-slot, allow the adapter 120 to be coupled circumferentially and axially for the purposes of installation. However, coupling is only circumferential during retrieval.

By way of example, the adapter 120 is axially coupled to the tool 118 because the coupling device 304 is in the horizontal portion of the j-slot during running. Once the clockwise rotation starts, the running tool 118 and coupling device 304 rotates with respect to the adapter 120 and slot 300 until the coupling device 304 contacts the vertical wall on the opposing end of the j-slot horizontal slot. At this point the coupling device 304 is still in the j-slot so can still transmit rotational force, but because it is no longer in the horizontal section it is no longer axially coupled. That is, the adapter 120 and tool 118 rotated together but can move vertically with respect to each other.

Figure 4:
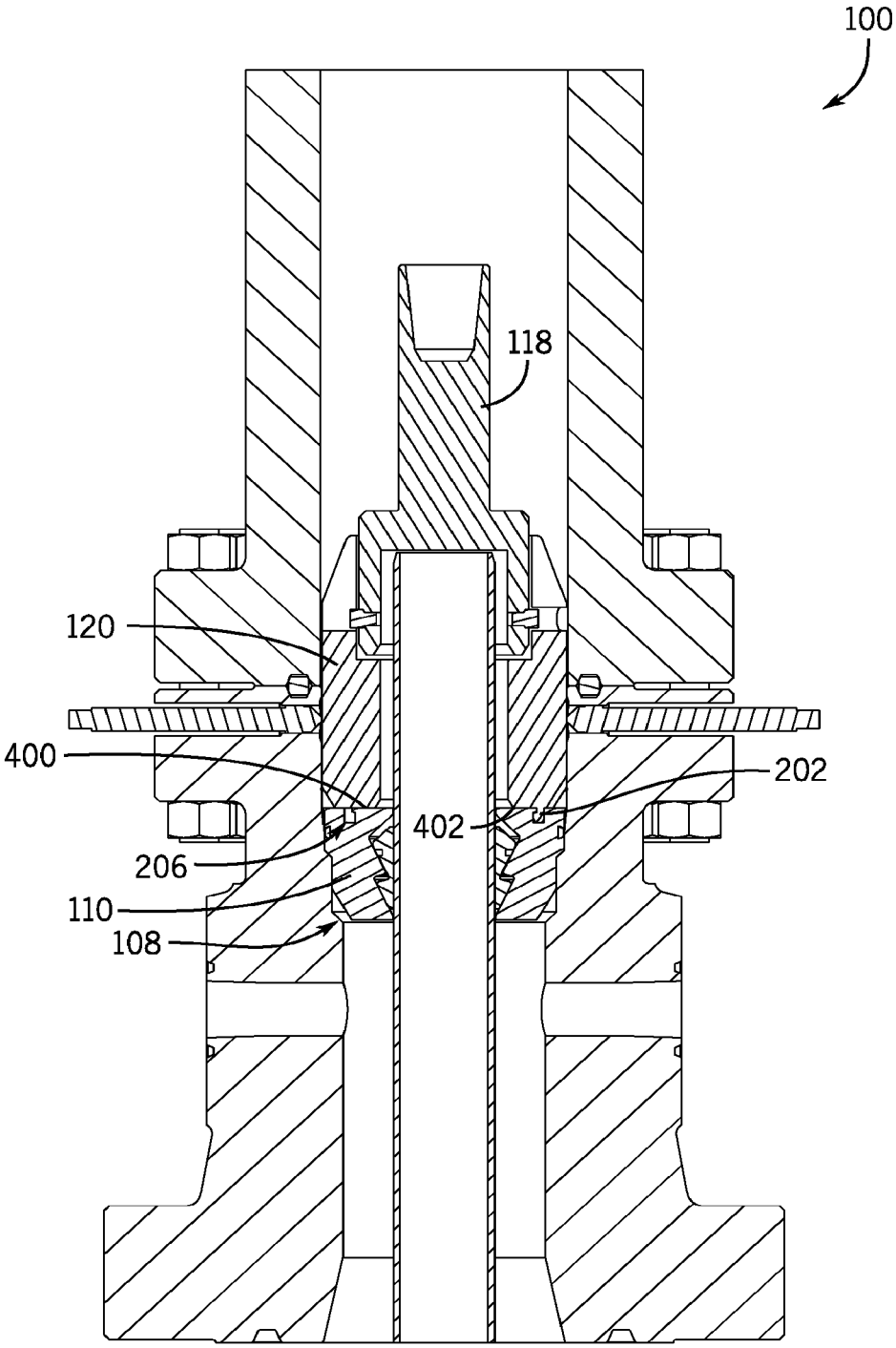
FIG. 4 is a cross-sectional view of an embodiment of a wellbore system, in accordance with embodiments of the present disclosure.

FIG. 4 is a cross-sectional view of an embodiment of the wellbore system 100 illustrating full engagement between the adapter 120 and the slip bowl 110. In this example, an adapter face 400 contacts a bowl face 402 as the fingers 202 extend into the grooves 206. It should be appreciated that the fingers 202 and grooves 206 may be particularly selected to enable contact between the faces 400, 402, but in other embodiments, the faces 400, 402 may not touch. Furthermore, as noted above, the faces 400, 402 may come together responsive to coupling between any type of coupling mechanism utilized to secure the adapter 120 to the slip bowl 110.

In at least one embodiment, insertion of the fingers 202 into the grooves 206 may not be a fully axial and/or accomplished in a single movement. By way of example, there the fingers 202 are threaded, rotation of the adapter 120 may incrementally move the fingers 202 into the grooves 206. In another example, one or more slots may be included, such as J-slots, so that axial movement be permitted to an extent before rotation is required prior to further axial movement. Such configurations may then provide additional loading faces to apply forces against when the slip hanger 108 is lifted or pulled from its location.

As shown in FIG. 4, the running tool 118 has moved into contact with the casing section 104, as opposed to FIGS. 1-3 where the running tool 118 did not contact the casing section 104. In at least one embodiment, such contact may serve as an indicator or feedback to operators regarding engagement of the fingers 202. However, it should be appreciated that various other embodiments may not include contact between the running tool 118 and the casing section 104 and that the contact may not be present in all embodiments.

Figure 5:
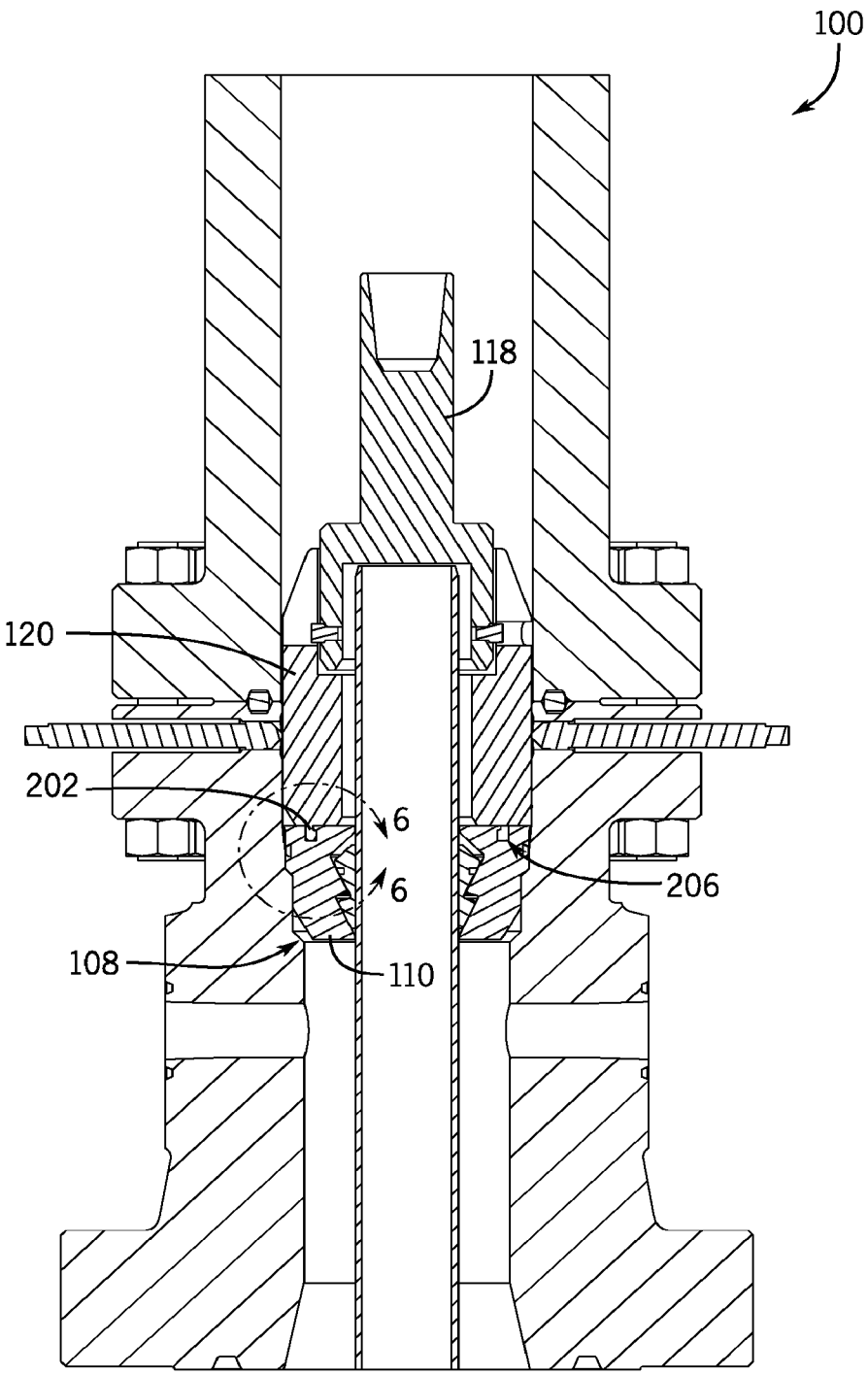
FIG. 5 is a cross-sectional view of an embodiment of a wellbore system, in accordance with embodiments of the present disclosure.

FIG. 5 is a cross-sectional view of an embodiment of the wellbore system 100 in which the adapter 120 is rotated into an engaged position with the slip bowl 110. In this example, the adapter 120 may be rotated (e.g., approximately 90 degrees) to stop the fingers on a bolt head or other anti-rotation component of the slip bowl 110. This rotation may also unlock the adapter 120 from the running tool 118, which may be coupled via a j-slot design, among other options. As a result, the fingers 202 may have a bearing contact with the slip bowl 110. However, it should be appreciated that rotation is one example of a method of securing the adapter 120 to the slip bowl 110. As noted above, a force or weight may drive a griping mechanism into a mating aperture to facilitate the connection. Additionally, rotation in a variety of directions may be used to engage clips or the like.

In at least one embodiment, the connections between the adapter 120 and the slip bowl 110 are substantially opposite the connections between the adapter 120 and the running tool 118 such that by coupling the adapter 120 to the slip bowl 110, the adapter 120 is disconnected from the running tool 118. It should be appreciated that one or more additional steps or movements may also be utilized to form and/or break connections between components. By way of example, additional rotation may be used to decouple the adapter 120 from the running tool 118, among other options.

Figure 6:
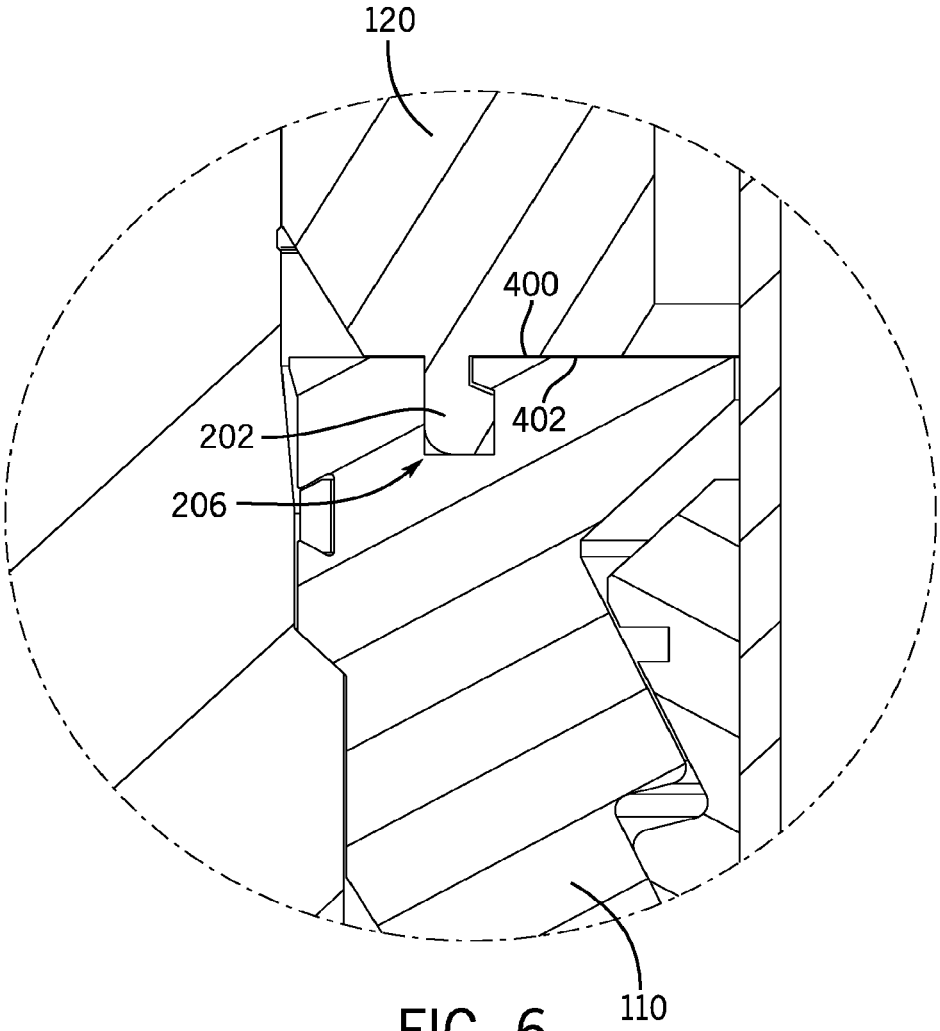
FIG. 6 is a cross-sectional sectional view taken along line 6-6, in accordance with embodiments of the present disclosure.

FIG. 6 is a cross-sectional section view taken along 6-6. As shown, the fingers 202 are positioned within the groove 206 and the adapter face 400 is in contact with the bowl face 402. In at least one embodiment, the fingers 202 may bear against a wall or other component of the slip bowl 110. As will be described, this engagement may facilitate removal of the slip bowl 110 while maintaining the components in an aligned and together arrangement.

Figure 7:
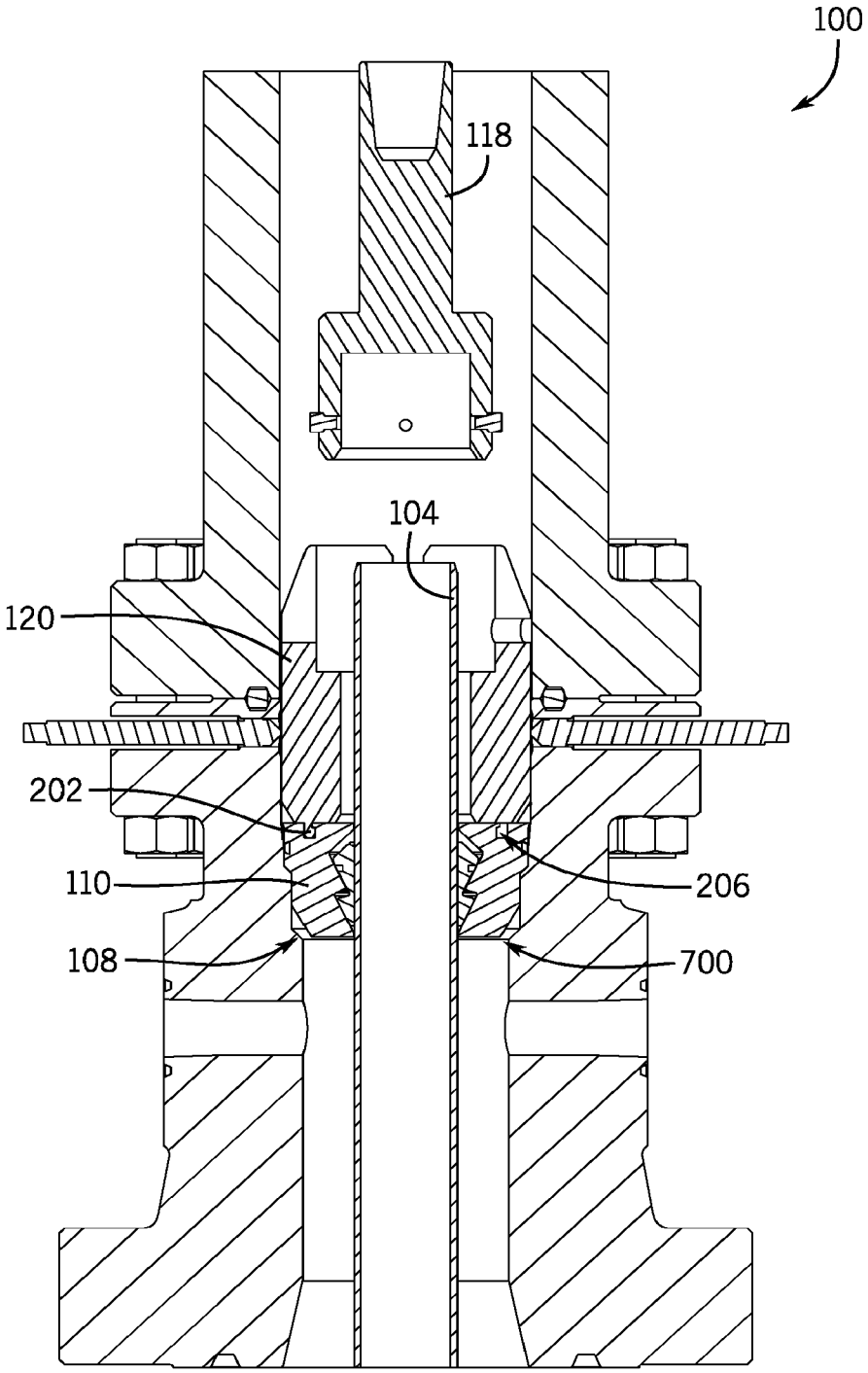
FIG. 7 is a cross-sectional view of an embodiment of a wellbore system, in accordance with embodiments of the present disclosure.

FIG. 7 is a cross-sectional view of the wellbore system 100 where the running tool 118 has been decoupled from the adapter 120. As a result, the running tool 118 may be removed from the wellbore while the remaining components remain in place, in part due to the connection between the adapter 120 and the slip bowl 110. Thereafter, the casing section 104 can be cut and then pulled up, where a collar or coupling will engage a bottom 700 of the slip bowl 110 to carry the system out of the wellbore. During retrieval, the fingers 202 (or other gripping mechanism utilized) will maintain the positioning of the slip bowl 110 and the adapter 120 will guide the slip bowl 110 up and out of the wellbore, thereby reducing the likelihood of twisting or being caught on uphole equipment. As a result, the slip bowl may be removed through the workover package while the casing 104 is pulled.

It should be appreciated that systems and methods of the present disclosure may utilize one or more additional or alternative features to engage the slip hanger 108. As an example, the slip hanger 108 may include a groove that receives dogs or a spring loaded component formed in the adapter 120. Additionally, in embodiments, the adapter may be threaded into the slip hanger 108. Accordingly, it should be appreciated that alternative coupling arrangements may be used.

Figure 8A:
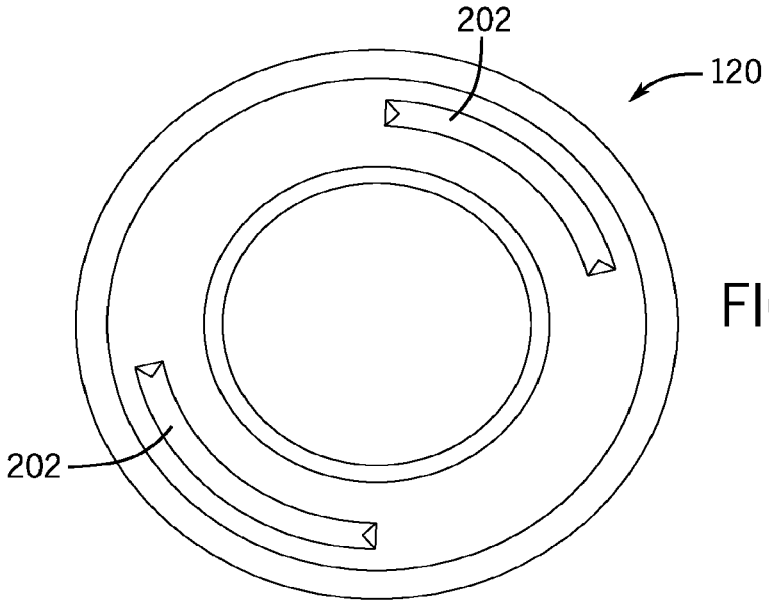
FIG. 8A is a bottom plan view of an embodiment of an adapter, in accordance with embodiments of the present disclosure.

FIG. 8A is a bottom view of an embodiment of the adapter 120. In this example, the fingers 202 are shown to extend circumferentially along a portion of the adapter 120. In this example, the fingers 202 are offset and span for approximately 90 degrees. However, it should be appreciated that different configurations may be utilized within the scope of the present disclosure. By way of example only, there may be more fingers 202 or the span may be greater than or less than 90 degrees.

Figure 8B:
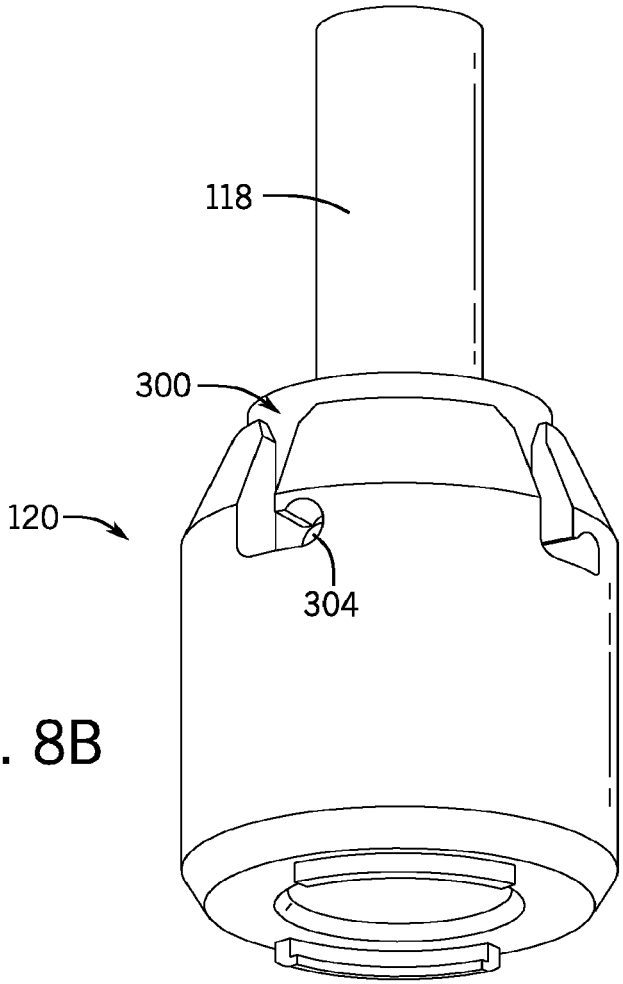
FIG. 8B is a perspective view of an embodiment of an adapter, in accordance with embodiments of the present disclosure.

FIG. 8B is a perspective view of an embodiment of the adapter 120 coupled to the running tool 118. As noted above, the fingers 202 are illustrated at a bottom portion of the adapter 120, with the walls 204 extending in a downward direction. The "j" configuration of the fingers 202 is further visible in this example, where the finger 202 includes a vertical portion and an angled portion arranged at an angle relative to the vertical portion. Moreover, the offset positions and extends of the fingers 202 are further visible.

Various embodiments also include the slots 300 for receiving the coupling device 304 associated with the running tool 118. In this example, the slots 300 also include a "j" or "L" configuration in that axial movement is permitted, to an extent, but upon rotation by a predetermined amount, continued axial movement is then blocked. In this example, axial movement is blocked by the position of the coupling device 304 after rotation. It should be appreciated that while two slots 300 are shown in this example, various embodiments may include more or fewer slots 300.

Figure 9:
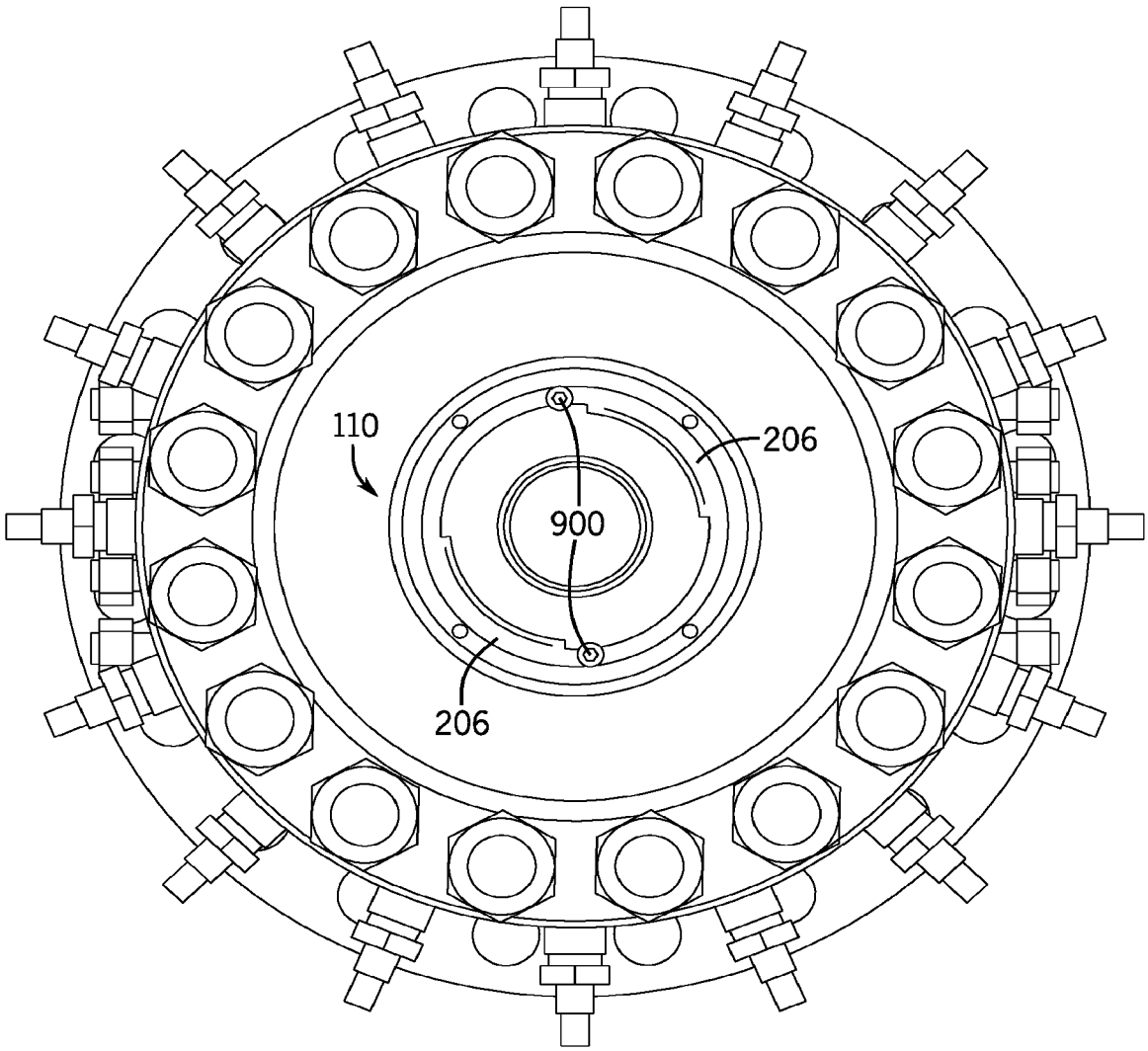
FIG. 9 is a top plan view of an embodiment of a slip bowl, in accordance with embodiments of the present disclosure.

FIG. 9 is a top plan view of an embodiment of the slip bowl 110. In this example, the slip bowl 110 is illustrating with the grooves 206. As noted above, in various embodiments, the grooves 206 may be j-shaped or any other shape to correspond to the fingers 202 to enable coupling between the adapter 120 and the slip bowl 110. In this example, and as noted above, an anti-rotation component 900, such as a bolt head or other fitting, may be positioned to block rotation of the adapter 120, relative to the slip bowl 110, beyond a certain point. As previously indicated, there may be more or fewer fingers 202, and as a result, the number of grooves 206 may also correspond to the number of fingers 202. However, it should be appreciated that there may be an un-equal number of fingers 202 and grooves. The groove 206 is also shown with entrance windows to accommodate the fingers when the adapter is engaged to the slip hanger as shown in FIGS. 3 and 4. It should be appreciated that the jay-slot (or slot with any other reasonable configuration) is continuous around the circumference and not just along the segments noted as the grooves 206 in FIG. 9. That is, the grooves 206 include openings that allow the fingers 202 to stab into the groove 206. Once the adapter 120 is rotated relative to the slip hanger 108, the fingers 202 then engage additional portions not labeled in FIG. 9. Accordingly, these windows allow the fingers 202 to stab into the slip hanger 108 before rotation.

Figure 10:
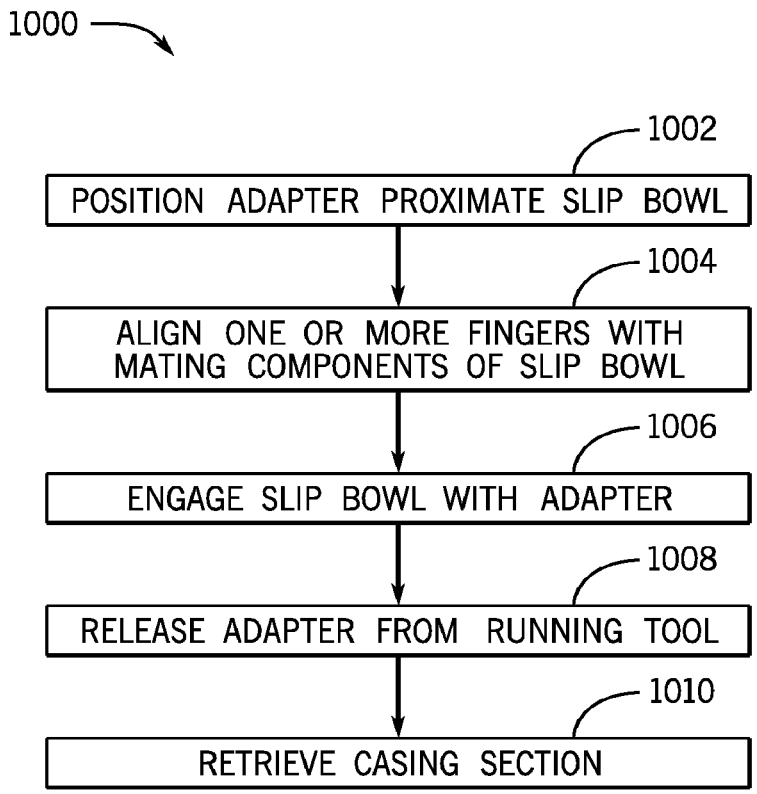
FIG. 10 is a flow chart of an embodiment of a method for retrieving a wellbore component, in accordance with embodiments of the present disclosure.

FIG. 10 illustrates a flow chart of a method 1000 for removing a downhole component, such as a slip hanger. It should be appreciated that steps of methods described herein may be performed in any order, or in parallel, unless otherwise specifically stated. Furthermore, there may be more or fewer steps. In at least one embodiment, a method may include positioning an adapter proximate to a slip bowl 1002. The method may also include aligning components of the adapter with the slip bowl to facilitate full engagement 1004, which may include forming contact between opposing faces of the adapter and the slip bowl. Embodiments may also include rotating the adapter a predetermined amount to engage the slip bowl 1006. Embodiments may further include releasing a running tool 1008, where the running tool may be released at substantially a same time when the slip bowl is engaged. In at least one embodiment, a cutting operation is performed and the casing section is retrieved, where a collar/coupling or increased diameter portion is utilized as a catch on the slip hanger to facilitate removal from the wellbore 1010.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellbore system, comprising:

a slip hanger arranged within a wellbore component, the slip hanger having a mechanical receptacle; and an adapter configured to couple to the slip hanger, the adapter having one or more engagement members arranged to engage the mechanical receptacle, wherein the one or more engagement members extend into the mechanical receptacle and, responsive to a removal force, the adapter holds the slip hanger together to guide the slip hanger through a body of uphole wellbore equipment.

2. The wellbore system of claim 1, wherein the mechanical receptacle is formed in an uphole face of the slip hanger and configured to receive the one or more engagement members responsive to downward movement of the adapter.

3. The wellbore system of claim 1, wherein a connection between the one or more engagement members and the mechanical receptacle is at least one of a snap fit, an interference fit, a rotational fit, or a lifting fit.

4. The wellbore system of claim 1, wherein the one or more engagement members are in a j-configuration and the mechanical receptacle is a j-slot.

5. The wellbore system of claim 1, further comprising:

a casing suspended from the slip hanger; and a casing cutting tool configured to severe a portion of the casing.

6. The wellbore system of claim 5, wherein one or more of a collar or a coupling of the casing is configured to engage the slip hanger when the casing is removed from the wellbore after being severed by the casing cutting tool.

7. The wellbore system of claim 1, further comprising:

a slot formed in the adapter, the slot receiving one or more coupling devices of a running tool to secure the running tool to the adapter.

8. The wellbore system of claim 1, wherein the slip hanger comprises:

a slip bowl; and segmented slips.

9. The wellbore system of claim 1, wherein the one or more engagement members extend axially lower than a body of the adapter.

10. The wellbore system of claim 1, wherein the slip hanger is held together and guided through the body of uphole wellbore equipment by the adapter.

11. A wellbore system, comprising:

a running tool;

a slip hanger arranged within a wellbore component, the slip hanger having a mechanical receptacle; and an adapter configured to couple to the slip hanger, the adapter having one or more engagement members arranged to engage the mechanical receptacle, wherein the one or more engagement members extend into the mechanical receptacle and, responsive to a removal force, the adapter holds the slip hanger together to guide the slip hanger through a body of uphole wellbore equipment.

12. The wellbore system of claim 11, wherein a connection between the one or more engagement members and the mechanical receptacle is at least one of a snap fit, an interference fit, a rotational fit, or a lifting fit.

13. The wellbore system of claim 11, wherein the one or more engagement members are in a j-configuration and the mechanical receptacle is a j-slot.

14. The wellbore system of claim 11, further comprising:

a casing suspended from the slip hanger; and a casing cutting tool configured to severe a portion of the casing, wherein one or more of a collar or a coupling of the casing is configured to engage the slip hanger when the casing is removed from the wellbore after being severed by the casing cutting tool.

15. The wellbore system of claim 11, further comprising:

a slot formed in the adapter, the slot receiving one or more coupling devices of the running tool to secure the running tool to the adapter.

16. The wellbore system of claim 11, wherein the slip hanger comprises:

a slip bowl; and segmented slips.

17. The wellbore system of claim 11, wherein the slip hanger is held together and guided through the body of uphole wellbore equipment by the adapter.

18. A wellbore system, comprising:

an adapter adapted to connect to a running tool, the adapter having a slot to receive one or more coupling devices associated with the running tool; and a slip hanger arranged within a wellbore, the slip hanger supporting at least a portion of a tubular, the slip hanger having slips and a slip bowl, wherein the slip bowl includes one or more grooves configured to couple to one or more engagement members of the adapter;

wherein the running tool is configured to move the adapter toward the slip hanger and facilitate coupling of the adapter to the slip hanger;

wherein the slip hanger is held together and guided through a body of uphole equipment by the adapter when the slip hanger is removed from the wellbore.

19. The wellbore system of claim 18, wherein a coupling configuration between the one or more engagement members and the one or more grooves is at least one of a j-slot fit, a snap fit, an interference fit, a rotational fit, or a lifting fit.

20. The wellbore system of claim 18, wherein the one or more grooves are formed in an uphole surface of the slip bowl.

* * * * *